US005237707A

United States Patent [19]

Lowrie

[11] Patent Number: 5,237,707

[45] Date of Patent: Aug. 24, 1993

[54] SAFETY HELMETS

[75] Inventor: Robert Lowrie, Whitton, Great Britain

[73] Assignee: Aran Fire & Safety (U.K.) Ltd., United Kingdom

[21] Appl. No.: 828,909

[22] PCT Filed: May 25, 1990

[86] PCT No.: PCT/GB90/00819

§ 371 Date: Jan. 24, 1992

§ 102(e) Date: Jan. 24, 1992

[87] PCT Pub. No.: WO90/14778

PCT Pub. Date: Dec. 13, 1990

[30] Foreign Application Priority Data

Jun. 3, 1989 [GB] United Kingdom ..... 8912839

[51] Int. Cl.[5] ..... A42B 3/00

[52] U.S. Cl. ..... 2/416; 2/424; 128/201.23

[58] Field of Search ..... 2/2.1 R, 6, 410, 411, 2/416, 417, 424, 414; 128/201.22, 201.23, 201.24, 206.21, 206.23, 206.24, 206.28, 207.11

[56] References Cited

U.S. PATENT DOCUMENTS

| | | | |
|---|---|---|---|
| 3,130,415 | 4/1964 | Colley | 2/6 |
| 3,167,069 | 1/1965 | Lobelle | 128/201.24 |
| 3,221,339 | 12/1965 | Correale, Jr. | 2/6 |
| 3,366,972 | 2/1968 | Wise et al. | 2/6 |
| 3,438,060 | 4/1969 | Lobelle et al. | 2/6 |
| 3,624,663 | 11/1971 | Jones . | |
| 3,789,427 | 2/1974 | Aileo . | |
| 4,549,541 | 10/1985 | Sundahl | 128/201.24 |
| 4,713,844 | 12/1987 | Westgate | 2/411 |

FOREIGN PATENT DOCUMENTS

| | | |
|---|---|---|
| 105813 | 4/1984 | European Pat. Off. . |
| 1435758 | 10/1968 | Fed. Rep. of Germany . |
| 6937652 | 1/1970 | Fed. Rep. of Germany . |
| 3108148 | 9/1982 | Fed. Rep. of Germany . |
| 1512479 | 1/1968 | France . |
| 2182568 | 5/1987 | United Kingdom . |

*Primary Examiner*—Clifford D. Crowder
*Assistant Examiner*—Michael A. Neas
*Attorney, Agent, or Firm*—Mason, Fenwick & Lawrence

[57] ABSTRACT

Safety helmets, totally encasing the wearer's head and incorporate breathing apparatus supplying air to and exhausting air from an isolated volume within the helmet, are well known. The isolated volume is defined by a viewing panel, an annular seal and the face of the wearer.

There is a problem in fitting and removing such a helmet which has been solved in prior art constructions by making the helmet from two shell halves, hinged together at the crown of the helmet.

The invention proposes a one-piece helmet shell, which has a front to rear dimension more the one and a half times that of the wearer's head, and providing a pad so supported that it can be displaced to the rear regions of the helmet, to facilitate fitting and removal of the helmet, and with the helmet fitted pushes the head of the wearer into pressure contact with the annular seal.

18 Claims, 2 Drawing Sheets

SAFETY HELMETS

Figure 1:
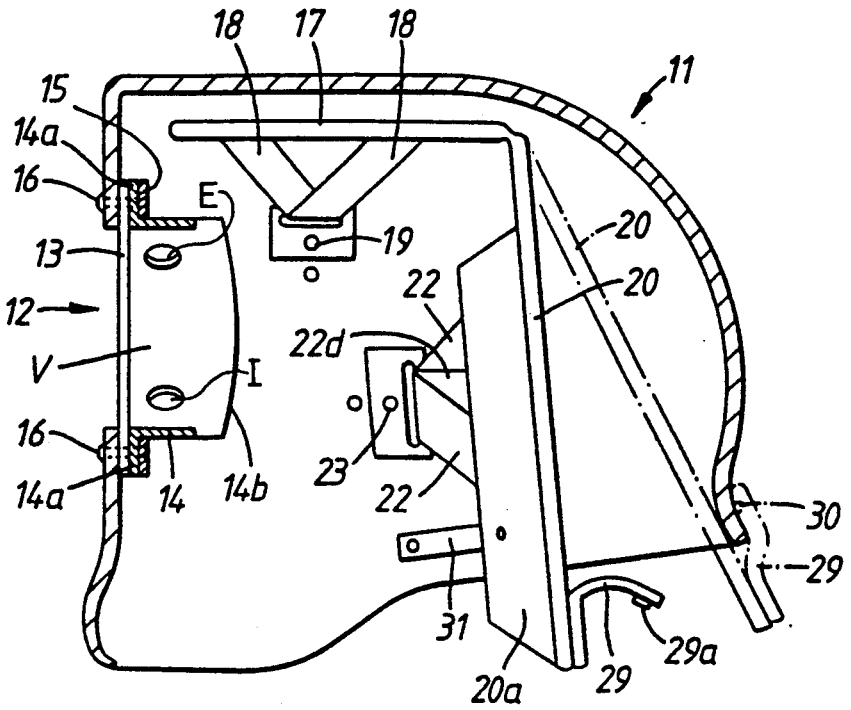

This invention relates to safety helmets and, more specifically, to safety helmets including breathing apparatus incorporated within the helmet.

Safety helmets, for use with breathing apparatus incorporated within the helmet, generally totally encase the head of the wearer and include a see-through panel with an annular seal surrounding the said panel and extending into the helmet. The said annular seal, when the helmet is in use, extends into pressure contact with the face of the wearer to form a seal across the forehead, down the sides of the face and across the chin. Thus, the seal forms an isolated volume between the face of the wearer and the see-through panel and means are provided for supplying air to said volume and exhausting spent air therefrom when the helmet is in use.

The helmet also includes flexible resilient means, intended to contact the rear of the head of the wearer, to force the wearer's face into pressure contact with the said annular seal, thus to maintain said isolated volume.

Such a helmet is, hereinafter, referred to as "a helmet of the type defined".

A problem with helmets of the type defined resides in inserting the wearer's head into the helmet between the face seal and the resilient means and this problem has been solved in prior art helmets by forming the helmet in two parts, a front part and a rear part, connected by a hinge at the crown of the helmet. The see-through panel and the annular seal are supported in the front part and the resilient means are contained in or anchored to the rear part, whereupon by hinging the two parts open the head of the wearer can be inserted into or removed from the helmet and, when in use, the two helmet parts are secured together by fasteners.

A serious disadvantage with the prior art multi-part shell helmets arises in the sealing of the joint between the helmet parts in the closed position and, for example, such multi-part helmets as have been proposed in the past have failed to meet the many test procedures specified for certain applications, for example fire-fighting applications, and therefore such prior art helmets have very limited uses.

The present invention seeks to provide a safety helmet, of the type defined capable of meeting all the requirements for all applications for such helmets.

According to the present invention there is provided a safety helmet of the type defined comprising a one-piece shell, characterised in that the flexible resilient means include a first pad and flexible resilient straps extending from the pad to anchor locations within the helmet, said flexible resilient straps serving to locate the said first pad in a position to engage the rear regions of the wearer's head when the helmet is in use.

Preferably the safety helmet is characterised in that the shell has a front to rear dimension greater than one and one half times the front to rear dimension of the wearer's head, and more preferably more than one and three quarter times the front to rear dimension of the wearers head.

In a preferred embodiment said flexible resilient straps are arranged to support the said first pad in pressure contact with the rear regions of the wearer's head to maintain the wearer's face in pressure contact with the annular face seal.

Preferably said flexible resilient straps are arranged to be stretchable towards the rear regions of the shell to allow the head of a wearer to readily enter the helmet between the annular face seal and the said first pad.

In a preferred embodiment the safety helmet is characterised by a second pad, in the upper regions of the helmet, said second pad being supported by flexible resilient straps fixed to anchor locations within the helmet and serving as a crown protection for the wearer.

In a preferred embodiment the upper regions of the said first pad are hingedly connected to the rear regions of the second pad.

Preferably said first pad includes stiffeners and said pad extends outwardly of the opening to the helmet to facilitate stretching of the resilient straps for fitting or removing the helmet to and from the head of the wearer.

Preferably the said first pad includes detachable anchoring means, for retaining the lower regions of said first pad in close proximity to the rear of the helmet shell whilst the helmet is being fitted or removed from the wearer.

In a preferred embodiment the first pad includes non-resilient strap means secured to anchor points in the helmet and adjustable to hold the first pad in pressure contact with and the rear regions of the wearer's head.

Figure 2:
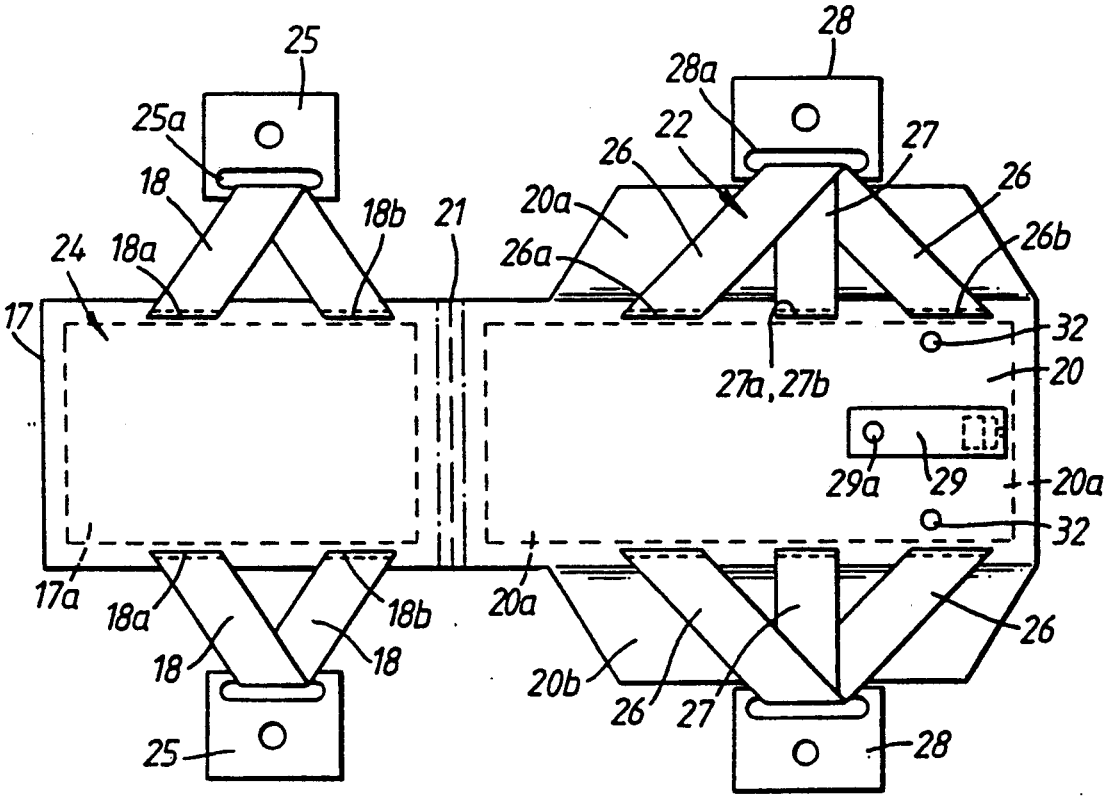
Figure 3:
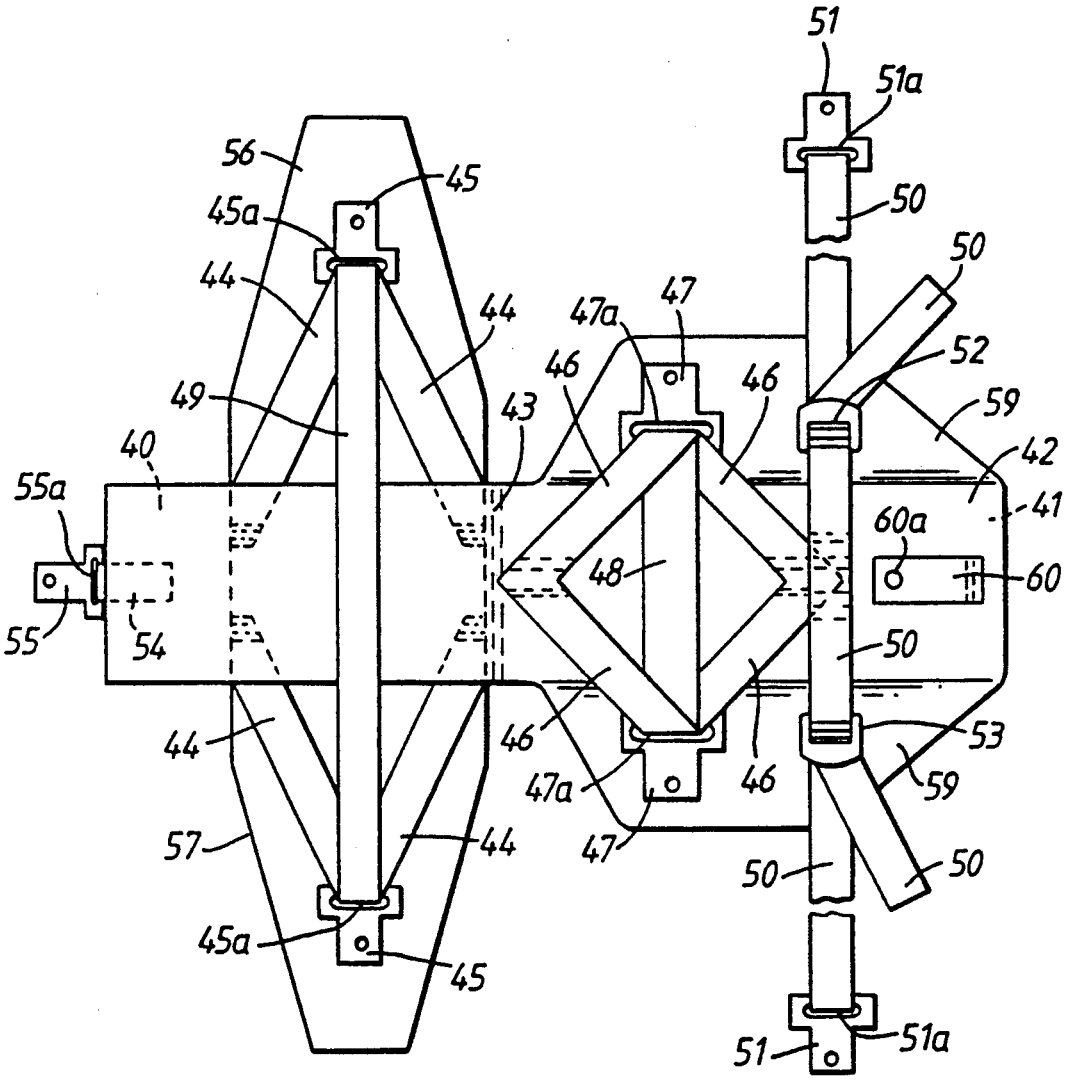

The invention will now be described further by way of example with reference to the accompanying drawings in which;

FIG. 1 shows, in vertical front to rear cross-section, a helmet in accordance with the present invention, FIG. 2 shows a plan view of a flexible resilient means suitable for use with the helmet shown in FIG. 1 and FIG. 3 shows a plan view of a second embodiment flexible resilient means.

The helmet illustrated in FIG. 1 generally comprises a one-piece shell 11 with a front to rear dimension some one and three quarter times the front to rear dimension of the wearer's head. The shell 11 has a viewing aperture 12 in its forward regions closed by a see-through panel 13, conveniently of a rigid transparent plastics material.

An annular flexible resilient seal 14 has one end region **14*a* splayed outwardly and secured between those regions of the helmet defining the aperture 12 and a rigid closed frame 15. The see-through panel 13, edge region 14*a* of seal 14 and the closed rigid frame 15 may be secured to the helmet shell 11 by common rivets 16**.

The edge region **14*b* of the seal 14, most remote from the helmet shell 11**, defines the face seal for the wearer.

The helmet will also include means I for providing air to, and means E for exhausting spent air from, that volume V defined by the see-through panel 13, the face of a wearer within the edge **14*b* of seal 14 and bounded by the seal 14** but as such breathing arrangements are well known and established in the art no further description thereof is necessary in this specification.

The helmet also includes a flexible resilient means including a first or rear pad 20 and a second or top pad 17. The first or rear pad 20 has a lower end positioned below the neck aperture **11*a* of the helmet and is supported by resilient straps 22 which extend to fixed anchor points 23 within the helmet. The upper end of first or rear pad 20 is hingedly connected by hinge connector means 21 (FIG. 2) to the rear end of the second or top pad 17 which extends over and serves to protect the crown of the wearer as a consequence of the fact that it is suspended in the helmet by resilient straps 18 which extend to fixed anchor points 19** within the helmet.

Referring now to FIG. 2 the pads 17 and 20 conveniently comprise slabs of a shock absorbing material 17*a* and 20*a* respectively, preferably a resilient foam or felt material, within a leather, leather-like or woven fabric covering 24, which may receive both the pads 17*a* or 20*a* and the covering 24 may have stitchings separating the pad 17*a* from the pad 20*a* and defining the hinge 21 for the assembly.

Each resilient strap 18, there being a resilient strap on each side of the pad 17, has one end 18*a* stitched to the cover 24 and has its other end 18*b* passed through a slot 25*a* in an anchoring bracket 25 and returned and stitched to the covering 24 at a different location such that the parts of the strap 18 to each side of the bracket 25 make an angle of between 30 and 60 degrees with the adjacent edge of the pad 17.

The pad 20 also has the resilient straps 22 on each side thereof and the straps 22 each comprise two resilient straps 26 and 27, the strap 26 has one end region 26*a* stitched to the covering 24 and has its other end 26*b* passed through a slot 28*a* in an anchoring bracket 28 and returned to the cover 24 where said end 26*b* is stitched to the covering 24. In a relaxed condition the resilient strap 26 to each side of the bracket 28 makes an angle of between 30 and 60 degrees with the adjacent edge of the pad 20.

The resilient strap 27 has one end region 27*a* passed through the slot 28*a* in the bracket 28 and the two end regions 27*a*, 27*b* are brought together and stitched to the cover 24 such that the said strap 27 has its axis substantially at right angles to the adjacent edge of the pad 20.

The anchoring brackets 25 and 28 have apertures 25*b* and 28*b* respectively by which the said brackets may be secured to the fixed anchoring points 19 and 23 respectively.

Each said anchoring point 19 and 23 comprises a nut embedded in the helmet material and the brackets 25 and 28 are secured to their respective anchoring points 19 and 23 by screws which pass through the apertures 25*b* and 28*b* to the respective nut defining the anchoring points 19 and 23 respectively.

Whilst the resilience of the straps 19 and 22 will allow the helmet to accommodate varying head sizes the helmet may include two anchoring points 19 and/or 23, at each anchoring location, to allow the brackets 25 and 28 to be anchored to different anchoring points and thereby to allow for a wide range of different head sizes with maximum comfort to the wearer.

The pad 20 may include stiffeners (not shown) extending in the length direction of the pads 17 and 20 to facilitate deflection of the pad 20 towards the rear of the helmet when the helmet is being fitted or removed. As will be clearly seen from FIG. 1 the pad 20 extends outwardly of the helmet to facilitate displacement towards the rear of the helmet.

The pad also includes a strap 29, stitched at one end region to the pad 20 at a location remote from the pad 17, having a press fastening socket 29*a* at its free end engageable with a press fastener 30 at the rear of the helmet. Thus, when the pad 20 has been displaced to its rearmost position within the helmet the fastener socket 29*a* can be engaged with the fastener 30 to maintain the pad 20 rearwardly, leaving the wearer with both hands free to fit and manipulate the helmet and arrange the face seal comfortably before releasing the strap 29 to allow the pad 20 to move forwardly into resilient contact with the rear of the wearer's head.

The pad 20 also includes padded side panels 20*a* and 20*b*, one to each side of the panel 20, to allow a degree of wrap-around of the head of the wearer.

The helmet also includes straps 31, one to each side of the helmet, and each strap 31 has one end pivotably anchored to the helmet adjacent the opening thereto. Each strap 31 includes two or three press stud sockets, spaced apart but adjacent its free end, and said press stud sockets on each strap 31 are selectively connected to a press stud fastener 32, individual to each strap 31, on the pad 20.

To fit the helmet the pad 20 is pushed rearwardly until the fastener socket 29*a* can be secured on fastener 30. Then, with the pad 20 held rearwardly and with both hands free to manipulate the helmet the wearer can readily insert his/her head into the helmet, and roughly adjust the helmet until the face seal 14, is in comfortable location on the face. The strap 29 is then released to allow the resilient straps 26 and 27 to contract to bring the pad 20 into contact with the rear of the head of the wearer and again, by using both hands on the helmet shell and pushing the head rearwardly against the pad 20, the wearer can make any final adjustments to the fitting of the face seal 14.

The straps 26 and 27 thereafter resiliently hold the pad 20 in the pressure contact with the wearer's head and this pressure is balanced by the pressure contact of the seal 14 with the wearer's face so that the seal between the seal 14 and the wearer's face cannot be accidently broken.

The wearer can then secure a selected fastener socket on each strap 31 to its cooperating fastener 32, thus additionally retaining the lower regions of the pad 20 forwardly to prevent accidental displacement of the helmet.

In the second embodiment flexible resilient means illustrated in FIG. 3 includes a pad 40, hingedly connected to a pad 41 which are intended to protect the head of the wearer within the helmet shell. The pads 40 and 41 comprise slabs of shock absorbing material within a leather, leather-like or woven fabric covering 42 and the lines of stitching 43 between the pads 40 and 41 allow for the hinge movement of said pads 40, 41.

The pad 40 is supported in the helmet by resilient straps 44, there being a resilient strap 44 on each side of the centre line of the pad 40, and each strap 44 has one end stitched to the pad 40 and the other end passed through a slot 45*a* in an anchoring bracket 45 and returned and stitched to a different location of the pad 40 so that the sections of the strap 44 to each side of the anchor bracket 45 make an angle between 40 degrees and 60 degrees.

In like manner the pad 41 is supported in the helmet by resilient straps 46, one strap 46 on each side of the centre line of the pad 41, and each said resilient strap 46 has one end sewn to the pad 41 and its other end passed through a slot 47*a* in an anchoring bracket 47 and returned and stitched to a different location on the pad 41, such that the sections of strap 46 to each side of the anchor bracket 47 lie at an angle to one another.

A further resilient strap 48 has both its ends passed through the slots 47*a* in the two anchoring brackets 47 and returned and stitched to the central regions of the pad 41.

In the FIG. 3 embodiment a non-resilient strap 49 has its ends passed through the slots 45*a* in the two anchoring brackets 45 and turned back and stitched onto the strap 49, to limit the outward displacement of the anchoring brackets 45.

The pad 41 also includes a non-resilient strap 50 which has its ends passed through the slots 51*a* of the two anchoring brackets 51 and then passed to two quick release/tensioning devices 52 and 53 supported on that uninterrupted length of strap 50 between the anchoring brackets 51.

The pad 40 also includes a short strap 54 which has one end stitched to the pad 40 and its other end passed through a slot 55*a* in an anchoring bracket 55 and returned and stitched to the pad 40.

The pad 40 presents two side flaps 56 and 57, of flexible resilient material, one to each side of pad 40, and said flaps 56 and 57 serve to support ear phones (not shown) for a communication system for the helmet.

The pad 41 also presents two side flaps 58, 59 one on each side of pad 41, and which wrap around the rear side regions of the wearer's head when the helmet is fitted.

A strap 60 has one end region sewn to the pad 42 and presents a press-stud fastener socket 60*a* near its other end.

The second flexible resilient means shown in FIG. 3 is fitted generally into a helmet shell substantially as shown in FIG. 1 but in this example the anchoring bracket 55 is secured to an anchoring point in the forward regions of the helmet, thus to fix the front to rear location of the pad 40 and, via the hinged connection 43, the upper regions of the pad 42.

The anchoring brackets 45, 47 and 51 are secured to anchoring points within the helmet but, by adjusting the lengths of the straps 44, 49, 46, 48 and 50, said brackets 45 and 51, and in some cases brackets 47, can share common anchoring points to each side of the helmet shell. With the flexible resilient means fitted and anchored as described above the helmet is ready for use.

The helmet shell is fitted in similar manner to that described for the embodiment illustrated in FIGS. 1 and 2, with the quick release devices 52 and 53 released and the strip 50 free to extend, the lower regions of the pad 41 are pushed rearwardly of the helmet shell and secured by attaching the fastener socket 60*a* to the fastener 30 on the helmet shell.

With the lower regions of the pad 42 rearwardly within the helmet the wearer can insert his/her head into the helmet and adjust the face seal 14 to a comfortable position. The fastener socket 60*a* is then detached from the helmet and the resilient straps 46 resiliently apply the pad 42 to the rear of the wearer's head, to resiliently maintain the seal with the annular-face seal 14. At this stage some minor adjustments may be necessary to the fit of the helmet.

Once the helmet is comfortably fitted, the free ends of the straps 50 are gripped by the wearer and pulled to tension the strap 50, thus to secure the lower regions of the pad 42 in a non-resilient manner against the wearer's head and effectively guard against accidently displacement of the helmet.

In normal use the strap 49 will be slack, allowing the pad 40 to be resiliently displaced via the straps 44, for the comfort of the wearer but the length of such strap between the anchoring brackets 45 prevents the pad 40 from engaging the roof of the helmet shell, thus to guard against the wearer's head contacting the helmet shell, to the detriment of the wearer, in the event that a falling object should strike the helmet shell.

In practise it has been found that a helmet shell, comprising a one piece moulding as defined herein, offers the greatest security to a wearer. Being without splits or hinges the shell is resistant to all falling liquids and the flexible resilient means supporting the wearer's head within the helmet ensures that the wearer is protected against objects impacting the helmet and the helmet cannot be accidently displaced on the wearer's head such as would break the seal in the breathing volume between the wearer's face and the see-through panel.

I claim:

1. A safety helmet comprising:

a one-piece shell dimensioned to encase the head of the wearer, said shell having forward and rearward regions and a viewing aperture in said forward region;

a see-through panel closing said viewing aperture;

a seal surrounding said see-through panel and extending from said see-through panel into contact with the face of the wearer across the forehead of the wearer down the sides of the face and across the chin to form an isolated volume between the face of the wearer and said see-through panel;

air supply and exhaust means for supplying air to said isolated volume and for exhausting spent air from said isolated volume;

flexible resilient means for maintaining said isolated volume by forcing the wearer's head into pressure contact with said seal, wherein said flexible resilient means includes a first pad having an upper region, said first pad being located in said rearward region of said shell for engaging the rear of the wearer's head, and flexible resilient straps extending from said first pad to anchor locations within said helmet; and a second pad having a rear region hingedly connected to said upper region of said first pad, said second pad being supported by flexible resilient straps fixed to anchor locations within said helmet.

2. A safety helmet according to claim 1, wherein said shell has a front to rear dimension greater than one and one half times the front to rear dimension of the wearer's head.

3. A safety helmet according to claim 1, wherein said shell has a front to rear dimension of more than one and three quarter times the front to rear dimension of the wearer's head.

4. A safety helmet according to claim 1, wherein said flexible resilient straps are arranged to support said first pad in pressure contact with the rear regions of the wearer's head to maintain the wearer's face in pressure contact with said seal.

5. A safety helmet according to claim 1, wherein said flexible resilient straps are arranged to be stretchable towards the rear regions of the shell to allow the head of a wearer to readily enter the helmet between said seal and said first pad.

6. A safety helmet according to claim 1, wherein said first pad includes detachable anchoring means for retaining the lower regions of said first pad in close proximity to the rear of the helmet shell while the helmet is being fitted or removed from the wearer.

7. A safety helmet comprising:

a one-piece shell dimensioned to encase the head of the wearer, said shell having forward and rearward regions and a viewing aperture in said forward region;

a see-through panel closing said viewing aperture;

a seal surrounding said see-through panel and extending from said see-through panel into contact with the face of the wearer across the forehead of the wearer down the sides of the face and across the chin to form an isolated volume between the face of the wearer and said see-through panel;

air supply and exhaust means for supplying air to said isolated volume and for exhausting spent air from said isolated volume;

flexible resilient means for maintaining said isolated volume by forcing the wearer's head into pressure contact with said seal, wherein said flexible resilient means include a first pad having an upper region, said first pad being located in said rearward region of said shell for engaging the rear of the wearer's head, and flexible resilient straps extending from said first pad to anchor locations within said helmet; and a second pad having a rear region hingedly connected to said upper region of said first pad, said second pad being supported by flexible resilient straps fixed to anchor locations within said helmet, wherein said first pad includes stiffeners and extends outwardly of the opening of the helmet to facilitate stretching of the resilient straps for fitting or removing said helmet to and from the head of the wearer.

8. A safety helmet according to claim 7, wherein said shell has a front to rear dimension greater than one and one half times the front to rear dimension of the wearer's head.

9. A safety helmet according to claim 7, wherein said shell has a front to rear dimension of more than one and three quarter times the front to rear dimension of the wearer's head.

10. A safety helmet according to claim 7, wherein said flexible resilient straps are arranged to support said first pad in pressure contact with the rear regions of the wearer's head to maintain the wearer's face in pressure contact with said seal.

11. A safety helmet according to claim 7, wherein said flexible resilient straps are arranged to be stretchable towards the rear regions of the shell to allow the head of a wearer to readily enter the helmet between said seal and said first pad.

12. A safety helmet according to claim 7, wherein said first pad includes detachable anchoring means for retaining the lower regions of said first pad in close proximity to the rear of the helmet shell while the helmet is being fitted or removed from the wearer.

13. A safety helmet comprising:

a one-piece shell dimensioned to encase the head of the wearer, said shell having forward and rearward regions and a viewing aperture in said forward region;

a see-through panel closing said viewing aperture;

a seal surrounding said see-through panel and extending from said see-through panel into contact with the face of the wearer across the forehead of the wearer down the sides of the face and across the chin to form an isolated volume between the face of the wearer and said see-through panel;

air supply and exhaust means for supplying air to said isolated volume and for exhausting spent air from said isolated volume;

flexible resilient means for maintaining said isolated volume by forcing the wearer's head into pressure contact with said seal, wherein said flexible resilient means include a first pad having an upper region, said first pad being located in said rearward region of said shell for engaging the rear of the wearer's head, and flexible resilient straps extending from said first pad to anchor locations within said helmet for locating said first pad in position to engage the rear of the wearer's head; and a second pad having a rear region hingedly connected to said upper region of said first pad, said second pad being supported by flexible resilient straps fixed to anchor locations within said helmet, wherein said first pad includes adjustable nonresilient strap means secured to anchor points in said helmet for holding said first pad in pressure contact with the rear region of the wearer's head.

14. A safety helmet according to claim 13, wherein said shell has a front to rear dimension greater than one and one half times the front to rear dimension of the wearer's head.

15. A safety helmet according to claim 13, wherein said shell has a front to rear dimension of more than one and three quarter times the front to rear dimension of the wearer's head.

16. A safety helmet according to claim 13, wherein said flexible resilient straps are arranged to support said first pad in pressure contact with the rear regions of the wearer's head to maintain the wearer's face in pressure contact with said seal.

17. A safety helmet according to claim 13, wherein said flexible resilient straps are arranged to be stretchable towards the rear regions of the shell to allow the head of a wearer to readily enter the helmet between said seal and said first pad.

18. A safety helmet according to claim 13, wherein said first pad includes detachable anchoring means for retaining the lower regions of said first pad in close proximity to the rear of the helmet shell while the helmet is being fitted or removed from the wearer.

* * * * *